US007255262B2

(12) United States Patent
Duyst

(10) Patent No.: US 7,255,262 B2
(45) Date of Patent: Aug. 14, 2007

(54) SINGLE PIECE BULK BIN BLANK AND CONTAINER

(75) Inventor: Alan J. Duyst, Hanford, CA (US)

(73) Assignee: Weyerhaeuser Company, Federal Way, WA (US)

( * ) Notice: Subject to any disclaimer, the term of this patent is extended or adjusted under 35 U.S.C. 154(b) by 310 days.

(21) Appl. No.: 10/676,305

(22) Filed: Sep. 30, 2003

(65) Prior Publication Data

US 2005/0067475 A1 Mar. 31, 2005

(51) Int. Cl.
*B65D 5/46* (2006.01)

(52) U.S. Cl. ..... 229/120.17; 229/117.09

(58) Field of Classification Search ..... 229/120, 229/120.17

See application file for complete search history.

(56) References Cited

U.S. PATENT DOCUMENTS 345,510 A * 7/1886 Jenkins et al. ..... 217/31
2,006,725 A * 7/1935 Usinger ..... 206/169
2,138,112 A * 11/1938 Means et al. ..... 229/120.1
2,515,151 A * 7/1950 Crane ..... 229/120.17
2,693,309 A * 11/1954 Giroux et al. ..... 229/120.04
2,747,785 A * 5/1956 Fink ..... 229/117.14
2,785,844 A * 3/1957 Metzger ..... 229/120.17
3,145,902 A * 8/1964 Nolen ..... 229/120.03
3,547,339 A * 12/1970 Bruce ..... 229/117.15
3,695,505 A * 10/1972 Wolf ..... 229/120.17
4,347,967 A * 9/1982 Loudermilk, Jr. ..... 229/120.17
4,396,145 A * 8/1983 Ditton ..... 229/120.17
4,574,996 A * 3/1986 Brian ..... 229/120.17

* cited by examiner

*Primary Examiner*—Tri M. Mai

(57) ABSTRACT

The present invention is directed to a divided bulk bin container and blank. In accordance with the present invention, a single sheet of foldable material is cut and scored to define container blank. The blank includes a pair of opposed first side panels and a pair of a opposed second side panels coupled with the first side panels. An outer bottom panel is connected with said first side panel and an inner bottom panel is connected with said second side panel. Also, a first divider panel is connected with said outer bottom panel and a second divider panel is connected with said inner bottom panel. Further, a divider slot is formed in said inner bottom panel and said second divider panel. The nature of the divider slot is such that the width of said divider slot is at least twice the thickness of the first divider panel.

7 Claims, 7 Drawing Sheets

SINGLE PIECE BULK BIN BLANK AND CONTAINER

FIELD OF THE INVENTION

This invention relates generally to containers and container blanks and, more specifically to convertible cap and tray type containers for bulk products.

BACKGROUND OF THE INVENTION

Bulk containers are known in the art. They are often used to ship large quantities of related materials. For example, in the food industry, large fruits such as melons, or grains such as wheat may be shipped in a bulk container. At the store, often the entire larger bulk container is placed on the market floor for customer access.

There are problems that arise from the standard bulk container. One fundamental problem results from the overall weight of the packaged material. For example, when shipping melons, the weight of the melons may damage melons located toward the bottom of the container. To alleviate the problem, the bulk containers often include a divider panel that is configured to divide the interior of the container into smaller storage regions. However, current bulk bin designs do not allow for the container and the divider panels to be formed from a single sheet of foldable material. As such, additional forming processes are required to make the container. This causes additional time and expense to those using the containers.

SUMMARY OF THE INVENTION

The present invention is directed to a divided bulk bin container and blank. In accordance with the present invention, a single sheet of foldable material is cut and scored to define container blank. The blank includes a pair of opposed first side panels and a pair of a opposed second side panels coupled with the first side panels. An outer bottom panel is connected with said first side panel and an inner bottom panel is connected with said second side panel. Also, a first divider panel is connected with said outer bottom panel and a second divider panel is connected with said inner bottom panel. Further, a divider slot is formed in said inner bottom panel and said second divider panel. The nature of the divider slot is such that the width of said divider slot is at least twice the thickness of the first divider panel.

The present invention further includes a container having a pair of opposed first side panels and a pair of opposed second side panels coupled with the first side panels. An outer bottom panel is connected with said first side panel, and an inner bottom panel is connected with said second side panel. As formed, the inner bottom panel is adjacent the outer bottom panel. Also, a first divider panel and a second divider panel are formed within the container whereby the second divider panel is substantially perpendicular to the first divider panel. The container is formed from a single piece of foldable material.

BRIEF DESCRIPTION OF THE DRAWINGS

The preferred and alternative embodiments of the present invention are described in detail below with reference to the following drawings.

DETAILED DESCRIPTION OF THE INVENTION

The present invention will now be described with reference to the accompanying drawings. The present invention is directed to a multi-section container formed from a single piece of foldable material. By way of overview and with reference to FIGS. 1-7, one suitable embodiment of the present invention includes a single piece blank 20 of foldable material arranged to form a container 50. Specific details of the blank 20 and container 50 are described with more particularity below.

The blank 20 is cut, scored, perforated or otherwise formed to include a plurality of panels which, when assembled, create the container 50 of the present invention. Wherever possible the same number is used in related panels of the blank 20 and container 50. More specifically, in all FIGURES, like numbers indicate like parts. Additionally, cuts are shown are solid lines, score lines as dashed lines and lines of perforation as broken lines.

For the purposes of this description herein, the downward direction is defined as the direction perpendicular to an outer bottom panel 26 that corresponds to the outer surface of the outer bottom panel 26 when the container 50 has been erected. The upward direction is defined as the direction perpendicular to the outer bottom panel 26 that corresponds to the inner surface of the outer bottom panel 26 when the container 50 has been erected.

The blank 20 and container 50, as shown in FIGS. 1-7 are made from any suitable material used in shipping. By way of non-limiting example, the present invention may be constructed from containerboard, paperboard, fiberboard, corrugated containerboard, plastics or combinations thereof. Specifically, the blank 20 and container 50 are constructed from a corrugated containerboard material that includes a single wall, double wall or triple wall material. However, as discussed, any other foldable material may be used to create the present invention.

Figure 1:
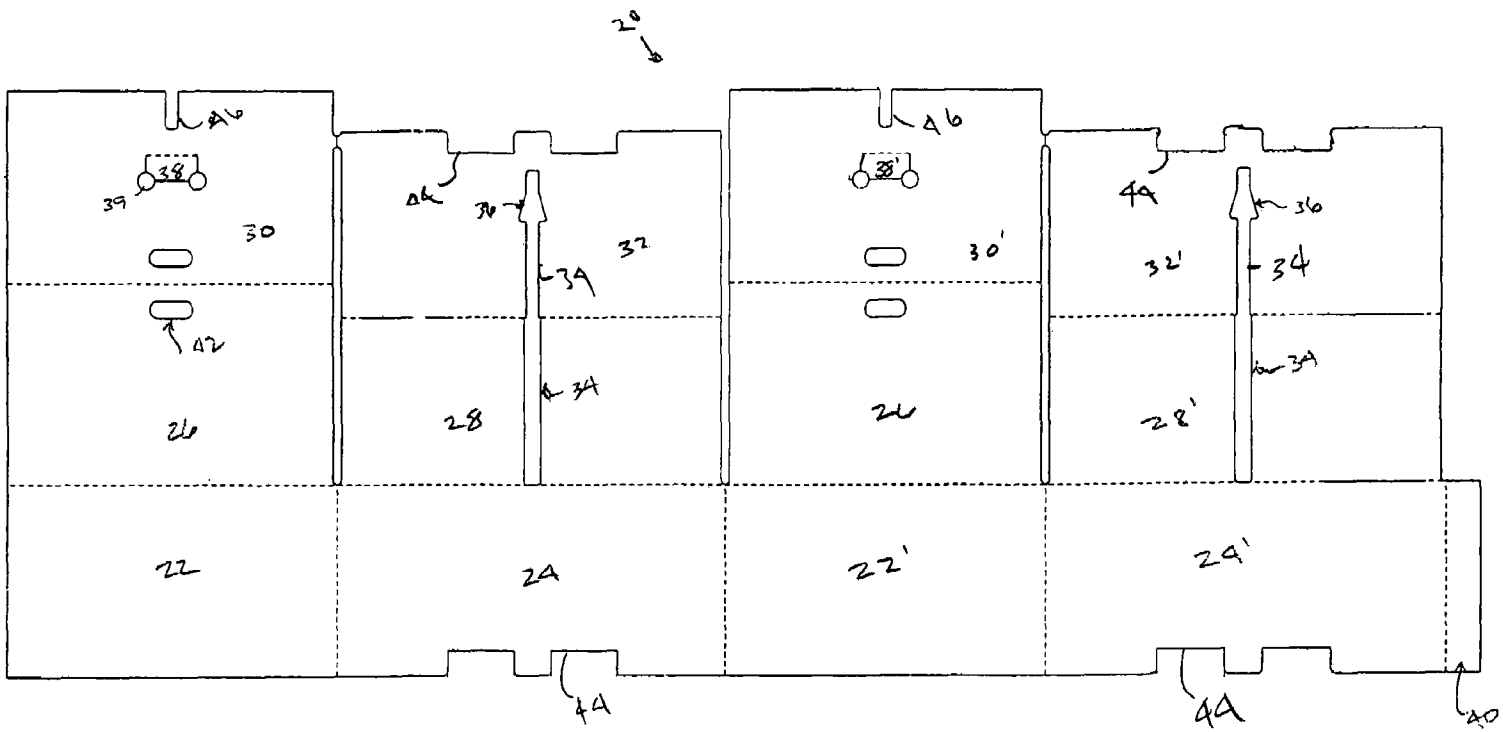
FIG. 1 is a plan view of a single piece container blank formed according to the present invention.

Referring now to FIG. 1, the blank 20 includes a pair of opposed first side panels 22, 22' and a pair of opposed second side panels 24, 24'. An outer bottom panel 26, 26' is connected with each first side panel 22, 22', respectively. Additionally, an inner bottom panel 28, 28' is connected with each second side panel 24, 24' respectively. Further, a first divider panel 30, 30' is connected with each outer bottom panel 26, 26'. Also, a manufactures joint 40 is connected with one of the first side panels 22, 22' or the second side panels 24, 24' to facilitate formation of the blank 20 into the container 50.

Each inner bottom panel 28, 28' includes a divider slot 34, which substantially bisects each respective inner bottom panel 28, 28'. The divider slot 34 continues through to each second divider panel 32, 32'. The divider slot 34 within the second divider panel 32, 32' may optionally include a locking slot 36, which is configured to interact with a locking panel 38, discussed in more detail below. The width of the divider slot 34 is variable, but is preferably slightly wider than at least twice the thickness of the each first divider panel 30, 30'.

Each second side panel 24, 24' and each second divider panel 32, 32' may include lift cutouts 44. Those skilled in the art will appreciate the function of the lift cutouts 44 is to provide access for a lift fork (not show) when the container 50 is employed without a support structure such as a pallet (not shown). In this manner, the container 50 may be stacked directly on another container 50 without any intervening structure, thereby saving on space and any burden created by the intervening structure. Those skilled in the art will also appreciate this container may also be employed with an intervening structure.

Each first divider panel 30, 30' also includes a divider cutout 46. The divider cutout 46 is substantially centrally located within each first divider panel 30, 30' and is generally aligned in a direction substantially identical to a main axis of the divider slot 34. Each first divider panel 30, 30' also includes an optional locking panel 38, each having locking panel cutouts 39.

FIGS. 2-7 illustrate the erection of the container 50 from the blank 20. Initially, the first side panels 22, 22' and the second side panels 24, 24' are folded around and secured by the manufacture joint 40. Those skilled in the art will appreciate that the manufacture joint 40 may be fastened to the respective side panel via any known means, such as, without limitation, staples, adhesive or both.

Figure 2:
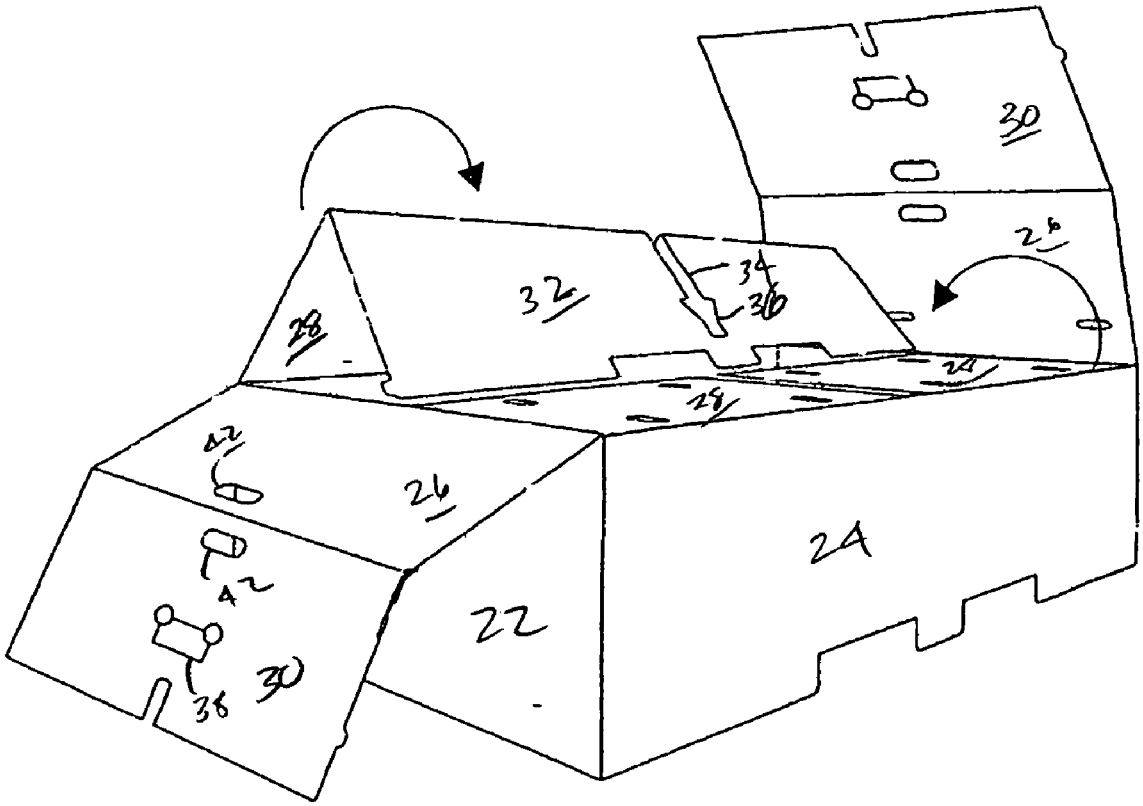
FIG. 2 is a perspective view of the container being formed according to the present invention.
Figure 3:
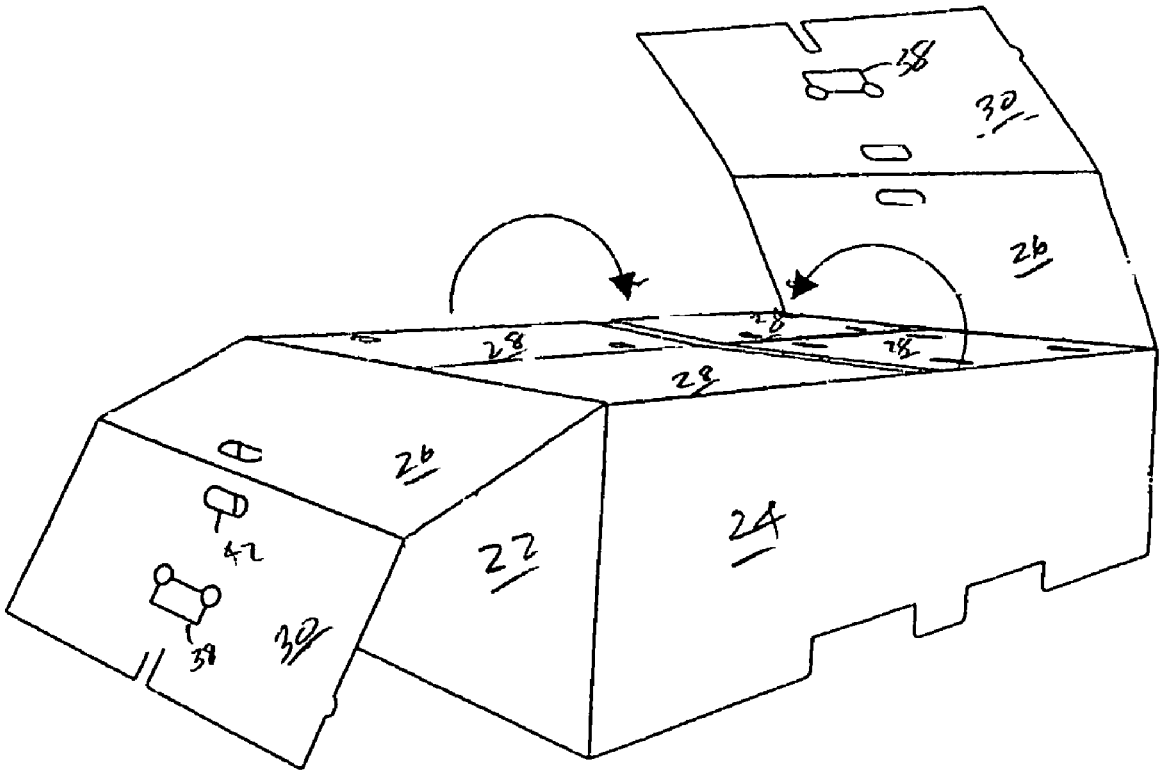
FIG. 3 is a perspective view of a partially assembled container formed in accordance with the present invention.
Figure 4:
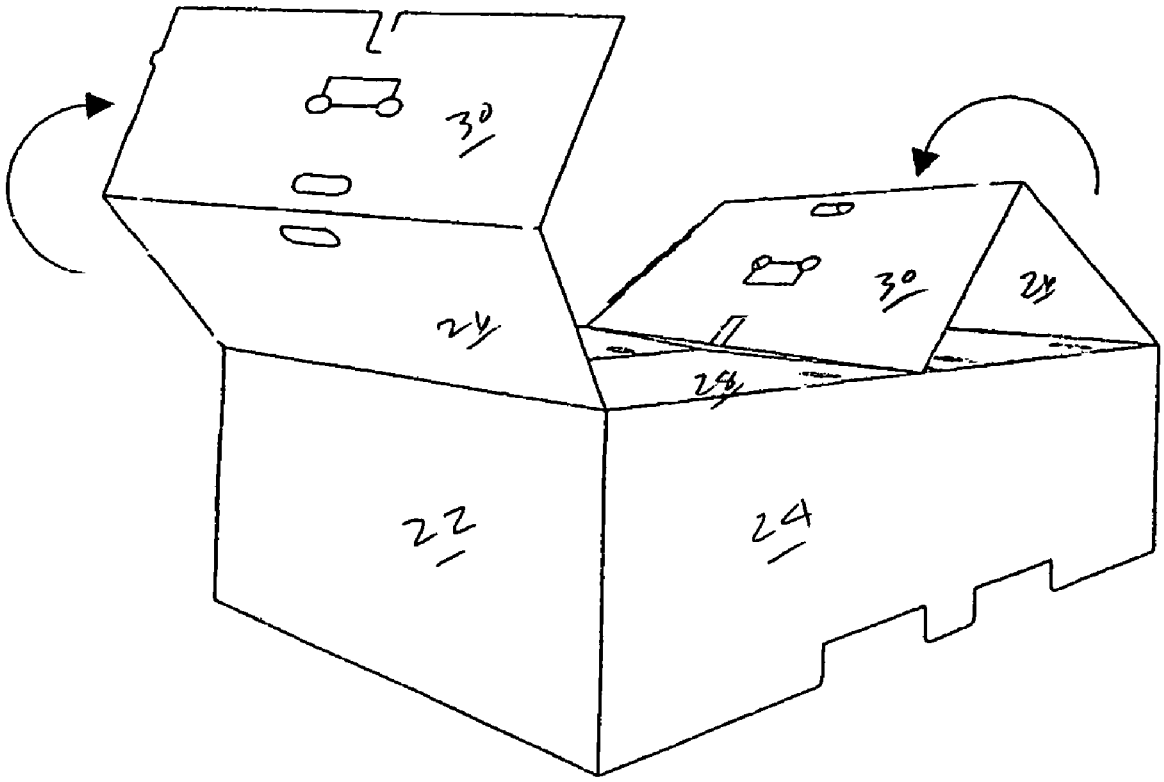
FIG. 4 is a perspective view of a partially assembled container made in accordance with the present invention.
Figure 5:
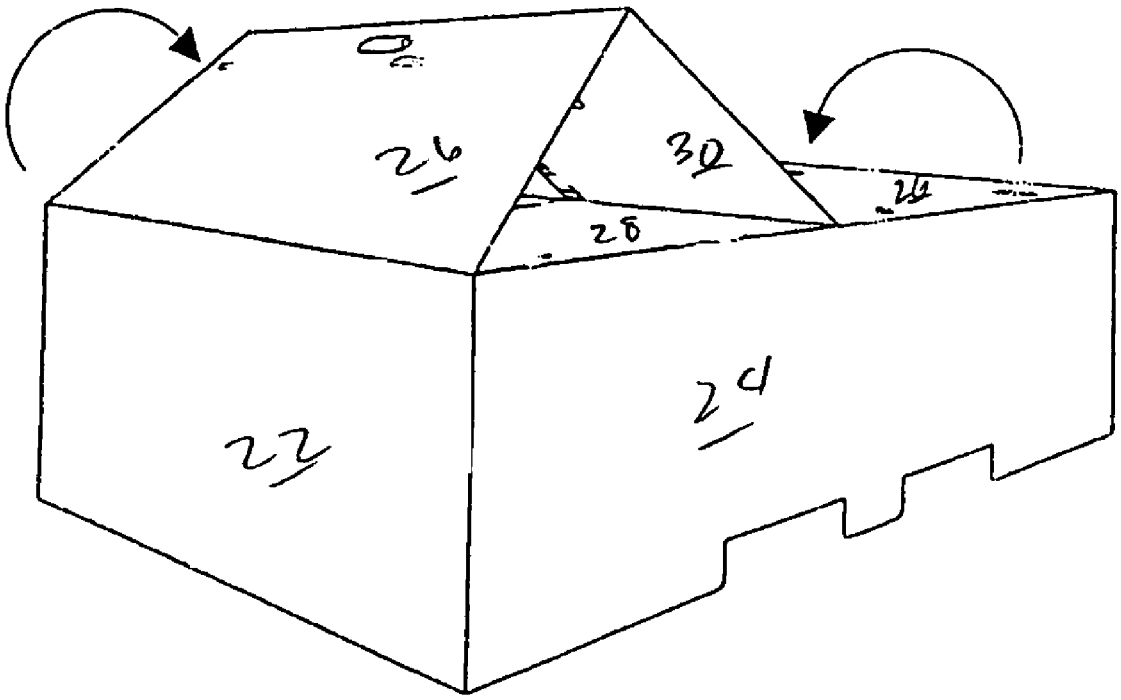
FIG. 5 is a perspective view of a partially assembled container.
Figure 6:
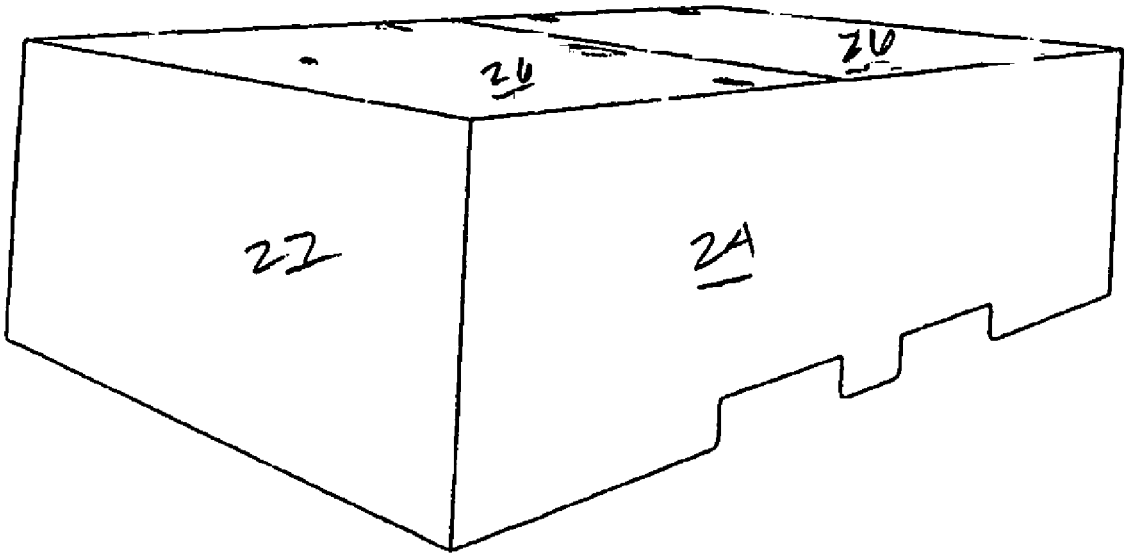
FIG. 6 is a perspective view of another aspect of the present invention; and, FIG. 7 is a perspective view of a container according to the present invention.

After the first side panels 22, 22' and the second side panels 24, 24' are held in place by the manufacture joint 40, the inner bottom panels 28, 28' and the second divider panels 32, 32' are folded inward, as best seen in FIG. 2. Subsequently, the outer bottom panels 26, 26' and the first divider panels 30, 30' are also folded inwardly. The first divider panels 30, 30' are inserted into the divider slots 34 and the outer bottom panels 26, 26' are over the inner bottom panels 28, 28', as best seen in FIGS. 3-6. If present, the locking panel 38 may then be pulled out such that locking panel 38 engages the locking slot 36, thereby assisting in maintaining the container's integrity. Those skilled in the art will appreciate the interaction between the locking panel 38 and the locking slot 36 without a detailed discussion.

Figure 7:
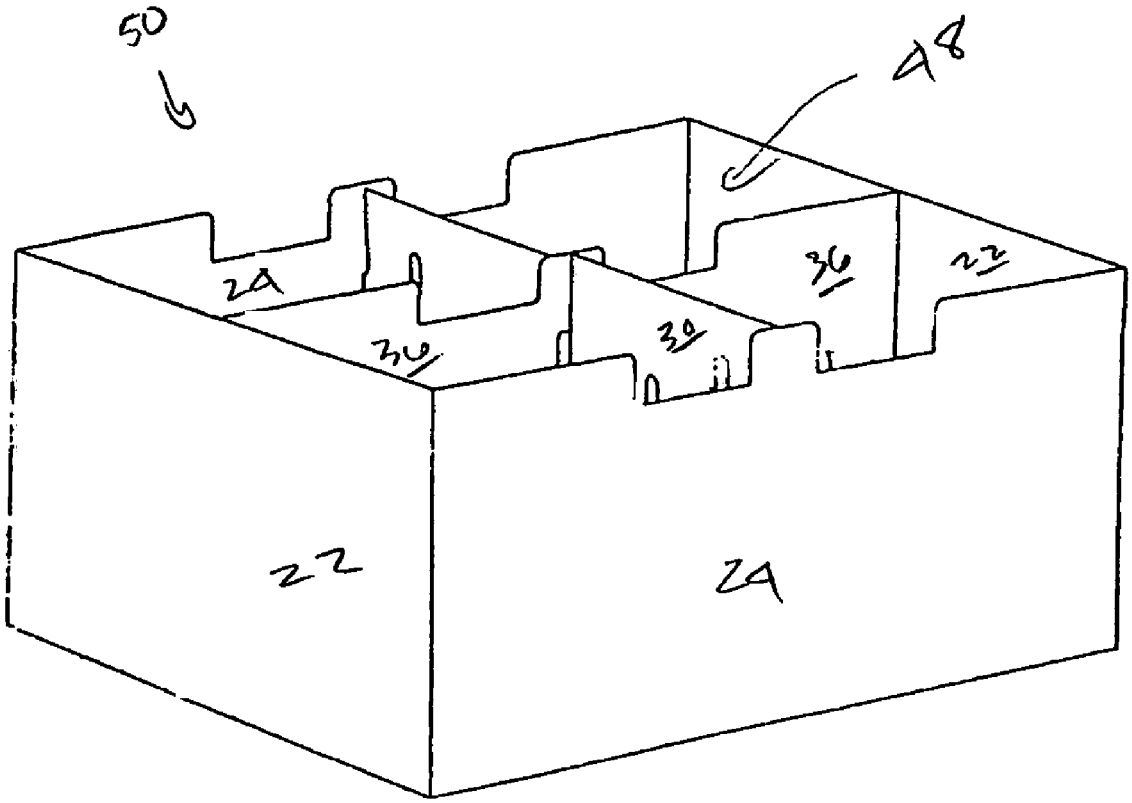

FIG. 7 illustrates an upright orientation of the container 50 formed according to the present invention. As can be seen, the present invention forms a divided container from a single piece blank 20. Specifically, the container 50 is divided into four sections 48. As depicted, each section 48 is substantially identical in size. However, it will be appreciated that various panel sizes may be varied to form a container 50 with different sized sections 48.

Any variety of additional elements may be included, such as, without limitation, vent holes, specialized liners or moisture barriers, etc., without departing from the spirit and scope of the present invention. Similarly, rounding or otherwise trimming the various panels is considered within the scope of the instant invention.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A single sheet of foldable material cut and scored to define a container blank, comprising:

a pair of opposed first side panels;

a pair of opposed second side panels, coupled with the first side panels;

a pair of opposed outer bottom panels, one of the outer bottom panels connected with one of said first side panels;

a pair of opposed inner bottom panels, one of the inner bottom panels connected with one of said second side panels;

a first divider panel connected with one of said outer bottom panels;

a second divider panel connected with one of said inner bottom panels;

a divider slot formed in said inner bottom panel and said second divider panel; and, a pair of lift cutouts formed in a bottom edge of said second side panel and a bottom edge of said second divider panel, said pair of lift cutouts being formed substantially equidistant from a center of the second divider panel, said pair of lift cutouts being substantially rectangular in shape;

wherein the width of said divider slot is at least twice the thickness of the first divider panel.

2. The blank of claim 1, wherein the sheet of foldable material is at least one of a containerboard, paperboard or corrugated material.

3. The blank of claim 2, wherein the corrugated material is at least one of a single wall, double wall or triple wall material.

4. The blank of claim 1, further comprising a divider cutout in said first divider panel.

5. A container, comprising:

a pair of opposed first side panels;

a pair of opposed second side panels, coupled with the first side panels;

a outer bottom panel connected with said first side panel;

an inner bottom panel connected with said second side panel, said inner bottom panel being adjacent said outer bottom panel;

a first divider panel;

a second divider panel, said second divider panel being substantially perpendicular to said first divider panel; and a pair of lift cutouts formed in a bottom edge of said second side panel and in a bottom edge of said second divider panel said pair of lift cutouts being formed substantially equidistant from a center of the second divider panel, said pair of lift cutouts being substantially rectangular in shape;

wherein, said container is formed from a single piece of foldable material.

6. The container of claim 5, wherein the sheet of foldable material is at least one of a containerboard, paperboard or corrugated material.

7. The container of claim 6, wherein the corrugated material is at least one of a single wall, double wall or triple wall material.

* * * * *